United States Patent [19]

Haines

[11] 4,312,523

[45] Jan. 26, 1982

[54] LABEL FOR CONTAINER HAVING PHARMACEUTICAL PRODUCT THEREIN

[75] Inventor: Russell R. Haines, Cherry Hill, N.J.

[73] Assignee: PACO Packaging Incorporated, Lakewood, N.J.

[21] Appl. No.: 89,645

[22] Filed: Oct. 29, 1979

[51] Int. Cl.[3] ..... G09F 3/04

[52] U.S. Cl. ..... 283/18; 40/306

[58] Field of Search ..... 40/310, 306; 283/19, 283/18, 21

[56] References Cited

U.S. PATENT DOCUMENTS

| | | | |
|---|---|---|---|
| 1,054,826 | 3/1913 | Cole | 283/21 |
| 1,145,367 | 7/1915 | Herter | 40/306 |
| 1,756,944 | 5/1930 | Gorton | 40/306 |
| 2,706,865 | 4/1955 | Miller | 40/306 |
| 3,702,511 | 11/1972 | Miller | 283/21 X |
| 3,946,507 | 3/1976 | Fergg et al. | 40/2 R |
| 4,128,954 | 12/1978 | White | 283/19 X |

*Primary Examiner*—Mark Rosenbaum
*Assistant Examiner*—John S. Brown
*Attorney, Agent, or Firm*—Seidel, Gonda, Goldhammer & Panitch

[57] ABSTRACT

A label for attachment to a container having a pharmaceutical product therein is in the form of an elongated strip substantially longer than the circumference of the container to which it is adapted to be secured. The strip is delineated into at least three zones with the two end zones including indicia identifying the product name, quantity of the product, and the expiration date. One of said end zones is provided with adhesive for securement to the container and is delineated from the remainder of the label by a perforation line.

8 Claims, 7 Drawing Figures

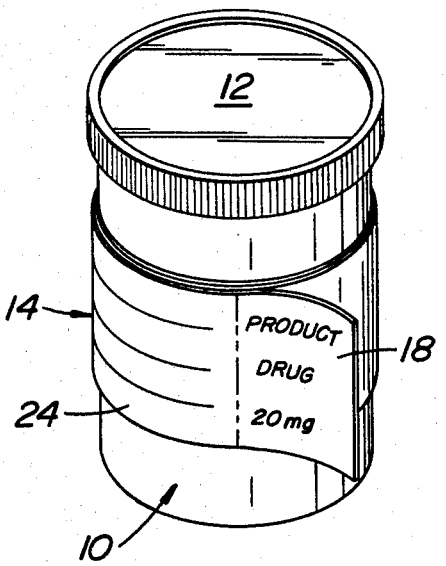
FIG. 1
FIG. 6
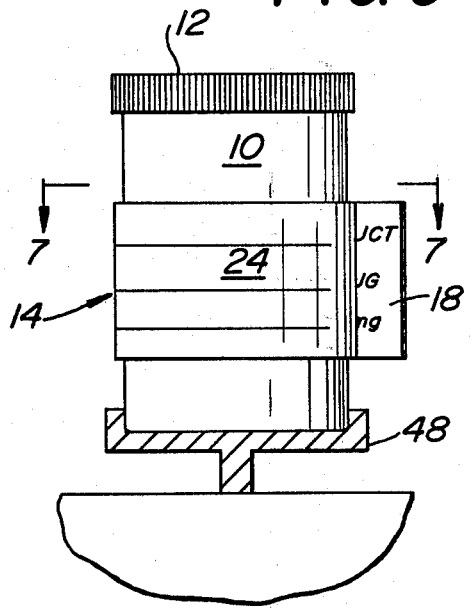
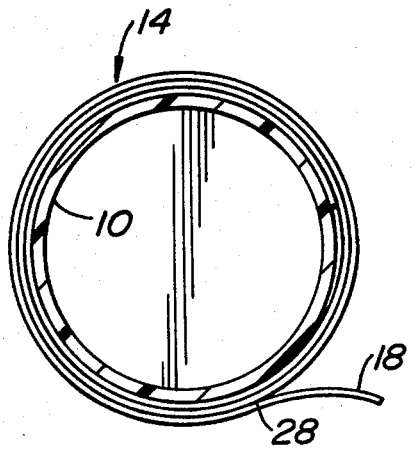
FIG. 7

LABEL FOR CONTAINER HAVING PHARMACEUTICAL PRODUCT THEREIN

BACKGROUND

It has been conventional here heretofore to provide pharmaceutical products with printed indicia in two different forms. In the first form, the printed indicia is on a separate leaflet which is introduced into a paper container which also includes the container having a pharmaceutical product therein. It also has has been proposed heretofore to provide printed indicia in the form of a leaflet which is trapped beneath the portion of the container label which lacks adhesive so that the leaflet may be withdrawn from under the label. Each of those types has disadvantages. As the trend toward containers becomes smaller, there is a limit to the size of a leaflet which can be introduced underneath the main label attached to the container. Further, there is a trend toward eliminating any paper box into which a bottle or container is introduced. Hence, there is a real problem associated with supplying the necessary information to a doctor or hospital, pharmacist, and to the patient with respect to a variety of information including the product name, product quantity, product weight, product expiration date, side effects with respect to the pharmaceutical product, recommended dosage, etc. The present invention is a solution to those problems.

SUMMARY OF THE INVENTION

The present invention is directed to a label for attachment to a container for a pharmaceutical product. The label is an elongated strip substantially longer than the circumference of the container to which it is adapted to be secured. The strip is delineated on one surface thereof, namely the exposed surface, into first, second and third zones. The two end zones included indicia identifying the product by name, the quantity of the product, and the expiration date of the product. One of the end zones is detachably connected to the center zone. The center zone contains indicia with respect to the product name and other indicia. Said one end zone contains adhesive on the opposite face thereof for securement to a container. Adhesive is provided on the opposite face of said label adjacent to the juncture of the second end zone and the center zone but spaced from the free end of the second end zone to thereby leave a pull tab defined by the free end of the second end zone.

The present invention is a departure from the prior art in that the label is substantially longer than the circumference of the container to which it is adapted to be secured. The center zone may include information for a physician or hospital, a pharmacist, and/or a patient. The end zones are preferably identical except for the extent to which they are adhesively secured to any surface therebelow or radially inwardly thereof.

It is an object of the present invention to provide a novel label for solution to an ever increasing problem of information to be supplied on a label or pharmaceutical product while the trend is to require ever increasing smaller sizes for containers of a pharmaceutical product whereby prior methods of dissemination of the required information are impractical.

Is an other object of the present invention to provide a novel label for attachment to a container of a pharmaceutical product, which label is simple and easy to apply.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective of a container having a pharmaceutical product therein and incorporating the label of the present invention.

FIG. 6 is shows apparatus in a generalized form for rotating the container while the label is applied thereto.

FIG. 7 is a sectional view taken along the line 7—7 in FIG. 6.

DETAILED DESCRIPTION

Figure 2:
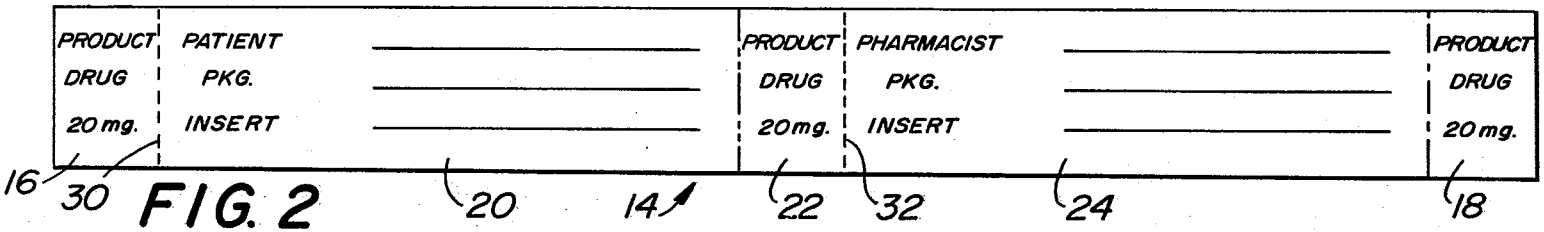
FIG. 2 is a top plan view of a preferred label in accordance with the present invention.

Referring to the drawing in detail, where like numerals indicate like elements, there is shown in FIG. 1 a container designated generally as 10 and having a removable cap 12 secured to one end of the container. The other end of the container is closed. The cap 12 may be threaded or otherwise snapped-fitted to the open end of the container 10. A label 14 in accordance with the present invention is secured around a central portion of container 10.

Figure 3:
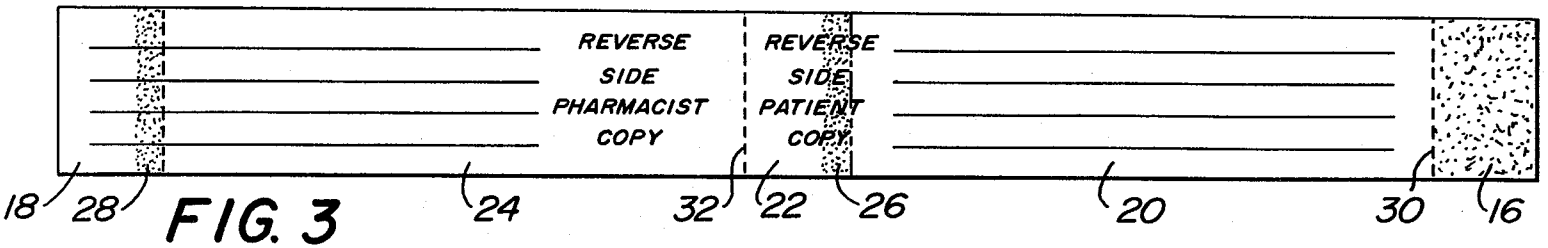
FIG. 3 is a rear plan view of the label shown in FIG. 2.

One preferred embodiment of the label 14 is shown in FIGS. 2 and 3. The label 14 is delineated into a plurality of zones including a first end zone 16 and a second zone 18. The label 14 includes center zones such as zones 20, 22 and 24. Zone 20 may be printed with indicia such as information of interest to the patient including the generic name of the product, side effects of the product, recommended dosage, etc. Similar information may be provided on the zone 24 which would be of interest to a pharmacist. Zone 22 contains the same information as zones 16 and 18.

The zones 16, 18 and 22 preferably contain the following information: generic name of the product, trademark for the product, quantity or weight of product in container 10, expiration date before which the product should be consumed, and manufacturers lot number. Zones 16, 18 are approximately of the same size but zone 18 is preferably slightly wider.

Referring to FIG. 3, the reverse side of the label 14 includes a layer of adhesive occupying the entirety of the reverse side of the first end zone 16, a stripe of adhesive 26 on the reverse side of the zone 22 immediately adjacent to zone 20, and a stripe of adhesive 28 on the zone 18 immediately adjacent to the zone 24. This will result in a pull tab at the free end of the zones 18 and 22. Zone 16 and 20 are delineated by a separable line such as perforation line 30. Zones 22 and 24 are delineated by a separable line such as perforation line 32.

When applied to the container 10, the label 14 is applied in a manner whereby zone 16 is applied first and the label 14 continually wound there around until the adhesive stripe 28 is applied to the layer of the label radially inwardly thereof while leaving a pull tab at the free end as shown in FIG. 1. A pharmacist may pull on the zone 18 pull tab thereby severing the adhesive stripe 28 and unwinding the label 14 to the perforation line 32. Thereafter zones 18 and 24 are severed from the remainder of the label 14 along perforation line 32. Thereafter, the container 10 with the remainder of the label may be delivered to a patient. The patient may pull on the zone 22 pull tab to separate the adhesive zone 26 and further unwind the label 14 down to the perforation line 30. Separation along line 30 leaves the zone 16 which remains attached to the container 10.

Figure 4:
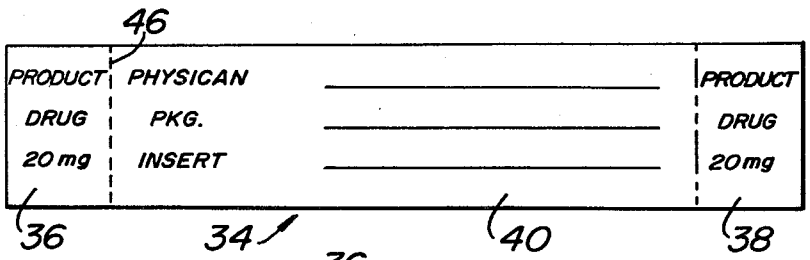
FIG. 4 is a top plan view of an alternative embodiment of the label of the present invention.
Figure 5:
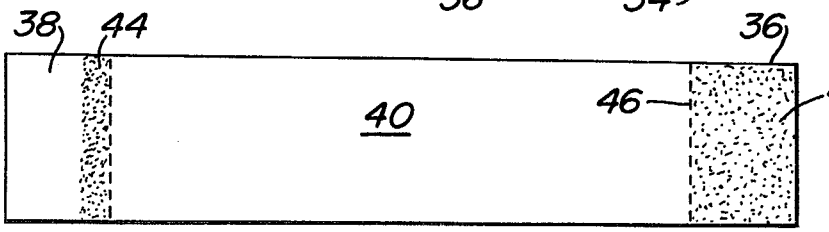
FIG. 5 is a rear plan view of the label shown in FIG. 4.

In FIGS. 4 and 5, there is illustrated another embodiment of the label of the present invention for use in connection with pharmaceutical products directed to physicians and hospitals. The label designated generally as 34 includes a first zone 36 and a second zone 38 each of which constitute end zones. The center zone is designated 40. Zone 36 is constructed like and contains the same information as zone 16. Zone 38 is constructed like and contains the same information as zone 18. Zone 38 is preferably slightly wider than zone 36. Thus, the entire reverse side of zone 36 is provided with adhesive 42 while zone 38 only contains a stripe of adhesive 44. Zones 36 and 40 are separated by a severable line such perforation line 46. A typical label 34 would be about $1\frac{1}{8}$ inches and about 11 inches long whereas container 10 would have a circumference of about 5 inches.

The label 34 is applied to a container 10 in the same manner as described above. Only one center zone is required on label 34 in connection with pharmaceutical products destined for doctors and hospitals. Indicia on the exposed surface of zone 40 includes generic name, recommended dosage, side effects, product identification, etc.

The labels 14 and 34 of the present invention may be applied to container 10 while the container 10 is rotated about its longitudinal axis by way of a support 48. Support 48 an apparatus for attaching the labels may be conventional as utilized commercially heretofore. The extra width of zones 18 and 38 obscures any misalignment in winding the labels on the container. Depending on the diameter of the container 10, the labels have a length which is at least 50% greater than the circumference of the container 10. The adhesive on labels 14, 34 may be heat activated, water activated, pressure sensitive, etc.

Thus, it will be noted that the label of the present invention provides as a minimum of two end zones with at least one center zone, and with the end zones having identical information printed thereon. Thus, the end zones include the product generic name, manufacturers lot number, quantity or weight of the pharmaceutical product in the container 10, expiration date beyond which the product should not be used, etc. The end zones may also include a manufacturers trademark or other identification. Thus, labels in accordance with the present invention solve a problem with respect to the trend towards smaller containers while at the same time requiring more information than is generally provided heretofore. In each embodiment of the labels 14 and 34, one of the end panels remains permanently affixed to the container.

The present invention may be embodied in other specific forms without department from the spirit or essential attributes thereof and, accordingly, reference should be made to the appended claims, rather than to the foregoing specification, as indicating the scope of the invention.

I claim:

1. A label for attachment to a container for a pharmaceutical product comprising an elongated strip substantially longer than the circumference of the container to which it is adapted to be secured, said strip being delineated on one surface thereof into first and second end zones and a center zone there between, the end zones including indicia identifying a product by name and quantity or weight as well as expiration date beyond which the product should not be used, said first end zone being detachably connected to the adjacent center zone, said center zone being longer than the end zones and containing indicia with respect to the product to be inserted in the container, said first end zone containing adhesive on the opposite face thereof for permanently securing the first end zone to a container, and an adhesive stripe on the opposite face of said label adjacent the juncture of said second end zone and said center zone, said stripe being spaced from the free end of said second end zone to thereby leave a pull tab defined by the free end of said second zone, said stripe constituting a means for releaseably securing said second end zone to an intermediate portion of the label when the label is wound around a container.

2. A label in accordance with claim 1 wherein said end zones also include a manufacturers lot number and indicia identifying the source of the product.

3. A label in accordance with claim 1 wherein said center zone includes at least two panels severably connected together by a perforation line.

4. A label in accordance with claim 1 in combination with a container, said label being wound around a central portion of said container and having a length which is at least 50% greater than the circumference of the container, said first end zone being permanently secured to said container.

5. A label for attachment to a container for a pharmaceutical product comprising an elongated strip substantially longer than the circumference of the container to which it is adapted to be secured, said strip being delineated on one surface thereof into a plurality of zones including first and second end zones as well as a middle zone, said end zones and middle zone each including indicia on one side identifying the product name as well as the product quantity and expiration date beyond which the product should not be used, a first intermediate zone between said first end zone and middle zone, a second intermediate zone between said middle zone and said second end zone, said first intermediate zone being detachably connected to said first end zone, said second intermediate zone being detachably connected to said middle zone, the reverse side of said first end zone being completely covered with adhesive, and the reverse side of each of said middle zone and second end zone containing an adhesive stripe.

6. A label in accordance with claim 5 wherein said end and middle zones are of the same size and also contain on said one side indicia with respect to the source of the product and the lot number.

7. A label for attachment to a container for a pharmaceutical product comprising an elongated strip substantially longer than the circumference of the container to which it is adapted to be secured, said strip being delineated on one surface thereof into first and second end zones and a center zone there between, the end zones including indicia identifying a product by name and quantity or weight as well as expiration date beyond which the product cannot be used, said first end zone being detachably connected to the adjacent center zone, said center zone being longer than the end zones and containing indicia with respect to the product to be introduced into the container, said first end zone containing adhesive on the opposite face thereof for permanently securing the opposite face of the first end zone to a container, means for releaseably adhering said second end zone to a portion of the label radially inwardly thereof when the label is applied to a container so that the second end zone and said center zone may be unwound and then severed from said first end zone, said end zones containing the same information and being of approximately the same size, and said center zone including at least two panels severably connected together by a perforation line.

8. A label in accordance with claim 7 wherein said label is tapered with said second end zone being slightly wider than said first end zone.

* * * * *